United States Patent [19]

Wakefield

[11] 4,149,719

[45] Apr. 17, 1979

[54] GOLF CUP FOR GREEN

[76] Inventor: William W. Wakefield, Urey, R.D., Glen Campbell, Pa. 15742

[21] Appl. No.: 794,741

[22] Filed: May 9, 1977

[51] Int. Cl.[2] ..... A63B 57/00

[52] U.S. Cl. ..... 273/34 R

[58] Field of Search ..... 273/34 R, 34 A, 34 B, 273/32 A, 193 R, 178 R, 180, 56

[56] References Cited

U.S. PATENT DOCUMENTS

| | | | |
|---|---|---|---|
| 1,505,375 | 8/1924 | Chenoweth | 273/34 R |
| 1,710,888 | 4/1929 | Munz | 273/34 R X |
| 2,457,759 | 12/1948 | Wales | 273/34 A |
| 2,929,628 | 3/1960 | Lane | 273/34 A |
| 4,026,561 | 5/1977 | Baldorossi et al. | 273/193 R |

*Primary Examiner*—George J. Marlo

[57] ABSTRACT

For a big ball golf game, a golf cup for positioning in a green having an opening less than twice the diameter of the ball to be received therein. A golf cup having, eccentric of its axis, a flag support. A golf cup constructed with plastic or other commercial pipe.

3 Claims, 10 Drawing Figures

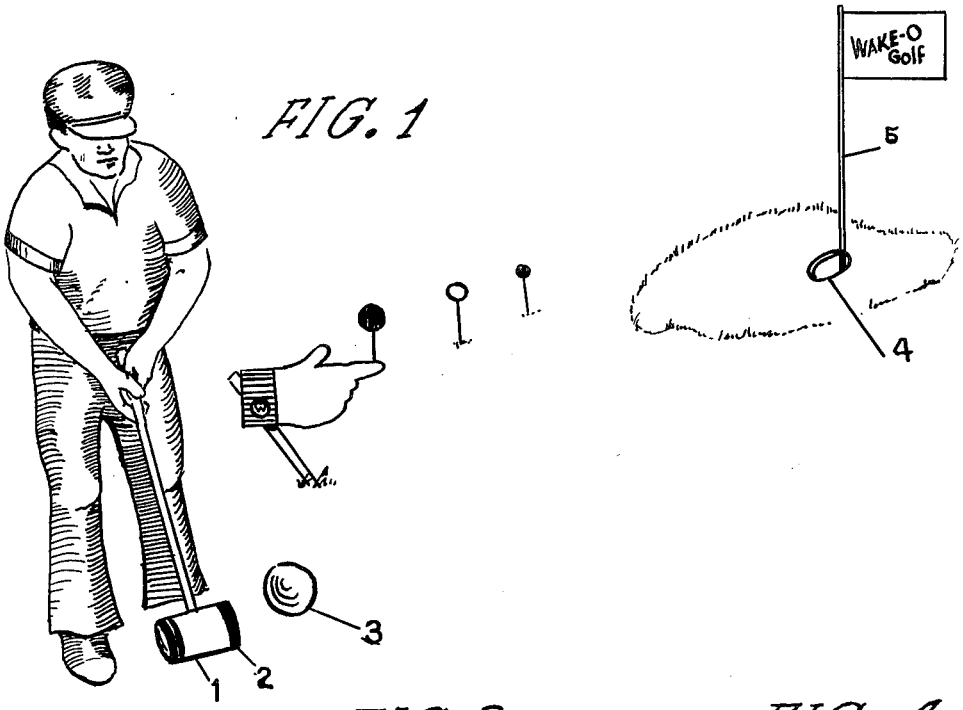
FIG. 1
FIG. 2
FIG. 3
FIG. 4
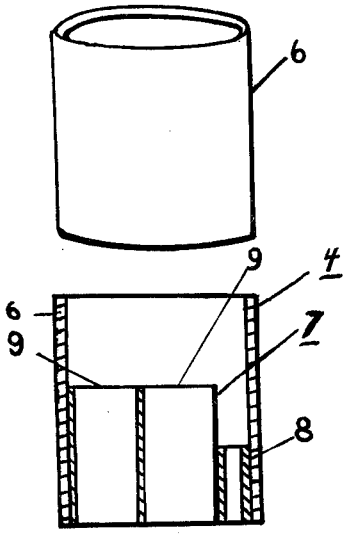
FIG. 5
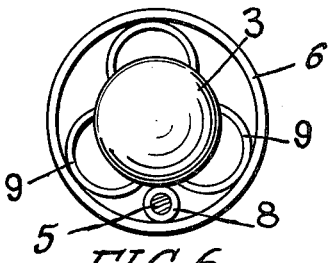
FIG. 6
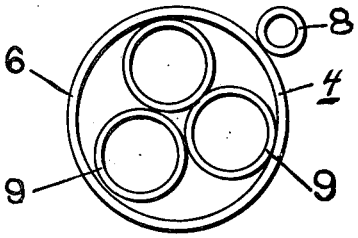
FIG. 7
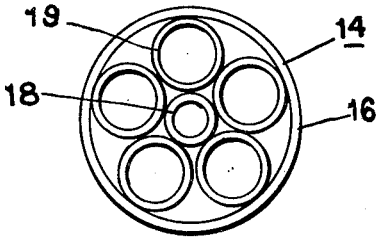
FIG. 8
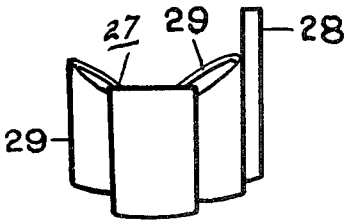
FIG. 9
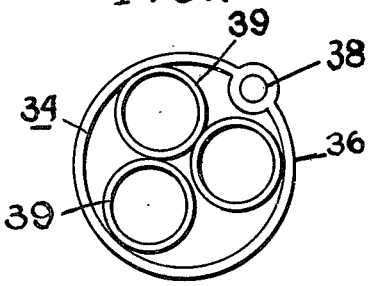
FIG. 10

GOLF CUP FOR GREEN

CROSS REFERENCES TO RELATED APPLICATIONS

Applicant has no other patent applications filed or pending in the U.S. Patent Office.

BACKGROUND OF THE INVENTION

The game of golf, in the early days, was played on a relatively small course with comparatively short fairways and with a hole in the turf of each of the greens for a target. Small courses were possible because the golf ball then in use had a leather covering stuffed with feathers and was relatively dead. With the adoption of the improved lively rubber-cored ball, having a diameter of about 1.6 inches and a mass of about 1.6 ounces, used on courses for regulation PGA golf today, much larger courses and longer fairways are needed, because the ball is more lively and can be driven further. A typical 18 hole regulation PGA golf course can easily occupy 160 or 180 acres of land. Considering the increased cost of land, and of maintenance, higher taxes, and frequently the need to provide transportation over long distances for the players, the game is threatened with serious economic problems. Also, the game tends to be confined to players who have had considerable practice, so as to have attained the minimum proficiency needed.

On such regulation courses, a cup with an inside diameter of 4¼ inches is placed in each green for a target. The cup is of such inside diameter in relation to the diameter of the ball, that the ball can fall or drop into the cup, even when the flag pole remains in its support at the center of the cup.

Later another game, called miniature golf, became popular with the general public and particularly with youth. It is primarily only a putting game using the regulation golf ball and golf club, and played on a very limited or restricted area, at times even indoors, with various obstacles placed between the tees and the greens.

There is also a game called croquet, the word being based on a French word suggesting a crook or a hooked stick. This game is played on a lawn or court which again is very much more limited in space than a regular golf course. Croquet uses a massive ball several inches in diameter and uses wickets through which the ball is maneuvered by striking it with a club or mallet.

The present invention is directed to a big ball golf game which is an improvement over the three games mentioned with several differences and advantages. By employing a ball about three inches in diameter and about seven ounces in mass made preferrably of a wood-like composition and a mallet type club, it is possible to have an 18 hole golf course on only about four acres. Shorter fairways for driving are possible because of the size, mass and composition of the ball. With the particular ball and mallet combination, an average good drive on the level would be in the order of 60 yards. While this game is similar to regular PGA golf with tees, fairways, greens, traps and roughs, and with similar rules and regulations, most players of all ages, even novices, can be reasonably competitive and proficient with little or no advanced instruction or practice. Also, the game poses less danger to players, because the ball is usually caused to roll and is seldom lofted. Also, the ball has a specific gravity which permits the ball to float in a water trap.

Because of the size of the ball employed, a new and novel golf cup is needed for use in the greens. The size of the cup has to be suitable to accommodate and to receive the particular size of ball employed, but not too large for a suitable target. This size is not possible when the staff or flag pole is positioned in the center of the cup.

Also, it has been found that an inexpensive cup with flag support, can be formed both for use in the green for regulation PGA golf and for use in the green for big ball golf, by employing segments of commercial pipe. Furthermore, such cup can embody design features and improvements not heretofore available.

PRIOR ART

References may be made to the following United States Letters Patent which relate (a) to the general game of big ball golf, (b) to the usual type of golf cup for positioning in a green, with the flag support at the center thereof, and (c) to the positioning of the staff or flag pole other than at the center of the cup into which the golf ball is to fall:

(a) U.S. Pat. No. 1,567,765 issued to C. S. Spaulding entitled "Game and Game Apparatus" discloses a golf game playable in a limited space employing a mallet or club, a big ball approximately 2 inches in diameter, and wickets for targets or stations, but with a hole at the final station.

(b) U.S. Pat. No. 1,675,089 issued to E. J. Bloom entitled "Golf Green Cup" discloses a conventional cylindrical golf cup that is inserted in a green with a flag pole positioned in the center of the cup and with adequate space between the cup and the pole so that the golf ball can enter the cup while the pole is in the cup. The patent explains in some detail, the need to change the position of the cup on the green from time to time because of excessive wear of the sod adjacent to the cup, and the need to provide adequate support for the flag pole. More basic golf cups with a flag support in their centers are disclosed in U.S. Pat. Nos. 621,390 and 951,649.

(c) U.S. Pat. No. 2,235,358 issued to K. J. Connell entitled "Golf Practicing Device" discloses a cylindrical enclosure surrounding a green with a hole in the center and a flag pole positioned at the back of the enclosure and remote from the hole. U.S. Pat. No. 3,027,163 issued to L. T. Saatzer entitled "Lawn Golf Game" discloses a disc for positioning on the surface of a lawn with different shaped openings in the center thereof to receive and hold the golf ball, and with a flag pole supported near the edge of the disc. U.S. Pat. No. 3,114,556 issued to A. Miller entitled "Game Apparatus" shows a disc or cylinder-like target to be placed on the playing surface, with flag pole supported at the center thereof. U.S. Pat. No. 3,434,721 issued to A. M. Travers entitled "Golf Putting Target" shows an elevated green with flags positioned adjacent the holes to receive the golf ball.

SUMMARY OF THE INVENTION

The present invention is directed to a golf game playable on a small course by golfers of various degrees of skill, using a ball more than 2 inches (and preferably about 3 inches) in diameter, and a special cup in the green as a target to receive the golf ball. To simulate regular golf, wickets are avoided. To have a hole or target of a size comparable to regular golf, it has been found that it is not possible to position the staff (a term used herein to include for example, a flag pole, a sighting target, or a signaling marker) at the center of the cup, as in regular golf. If so positioned, the cup would have to be too big a target for receiving the ball when the staff is positioned in the holder. Also, the purpose of the staff, namely, to assist the golfer to make his shot, is diminished if the staff is positioned away from the cup.

According to the present invention, the holder for the staff is positioned adjacent to the cylindrical wall portion of the cup. It has been found that uniformity of design with minimum production costs can be attained if this golf cup for use in a green, is made of readily available commercial plastic pipe, and thereby avoiding the need for expensive molds and dies to shape the golf cup or its parts. By the proper selection of pipes as to size, the cup provides desirable drainage features and a suitable support to receive the staff. If the pipes are not properly selected as to size, a player might insert the staff in the wrong opening and keep the ball from entering the cup so as to deprive the next golfer of making the hole or of having a correctly positioned marker.

BRIEF DESCRIPTION OF THE DRAWINGS

FIG. 1 is a basic illustration of a big ball golf game.

FIG. 2 is a perspective view of the cylindrical wall portion of a golf cup.

FIG. 3 is a perspective view of a cluster of pipes for insertion in the cylindrical wall portion.

FIG. 4 is a plan view of an assembled golf cup with the cluster inside the cylindrical wall portion.

FIG. 5 is a vertical section view taken on the plane indicated by the line A—A in FIG. 4.

FIG. 6 is a plan view looking downward into a cup with a staff and ball positioned inside.

FIG. 7 is a plan view of an alternate design of cup with staff support outside the cylindrical wall portion.

FIG. 8 is a plan view of an alternate design with flag support in center of the cup.

FIG. 9 is a perspective view of an alternate design for the cluster of pipes.

FIG. 10 is a plan view of a cup with the flag support formed in and as part of the cylindrical wall portion.

DESCRIPTION OF THE PREFERRED EMBODIMENT

Referring to the drawing, FIG. 1 shows a golfer with a club or mallet 1 preferably with a head or facing 2 formed of plastic, rubber or other material with suitable thickness and elasticity to drive or putt a ball 3 from the tee across the fairway toward the green in which a cup 4 is positioned. To permit playing the golf game on a course far smaller than the Professional Golf Association (PGA) regulation golf course, it has been found desirable to use a ball 3 that has a diameter in excess of two inches and preferably that is approximately 3 inches in diameter, formed of a wood-like composition having a mass of about a half a pound, and preferably having a plastic coating on the surface thereof.

As to the cup 4, it will be observed that at the back of the cup and away from the tee, a flag pole or staff 5 is supported adjacent the cylindrical wall or housing of the cup 4. As an important departure from the usual cup, the staff 5 is not positioned at the axis or center of the cup 4.

FIG. 2 shows a housing 6 to provide a cylindrical wall for the cup 4, formed of commercial pipe readily available at supply houses carrying pipe for plumbing and similar uses. The housing 6 is preferably formed of asphalt, polyethylene, polyvinyl chloride, acrylonitrile-butadiene-styrene, or other plastic material, because it is readily available and easy to work with. It has been found that a segment of pipe cut to a length of 6 inches, with a wall thickness of about $\frac{1}{4}$ inch, and an inside diameter of 5 inches is suitable for the housing 6.

FIG. 3 shows a cluster 7 of pipes, one support pipe 8 in the cluster having an inside diameter suitable to receive and to support the staff 5 substantially perpendicular to the green. The other spacer pipes 9 in the cluster 7 have one or more diameters not suitable to receive or to properly support the staff 5. While the cluster 7 is preferably formed of a collection of pipes all of plastic composition, it has been found that a copper pipe, adaptor or coupling, with an inside diameter of $1\frac{1}{8}$ inches makes a good support pipe 8 to be used in the cluster 7. The support pipe 8 can have a length the same as, or differing from, the lengths of the spacer pipes 9. If the spacer pipes 9 are of the same size as the support pipe 8, a careless golfer is likely to misplace the staff 5 by using the wrong opening and the wrong position, so as to handicap the next player.

FIG. 4 shows a typical cup 4 with a cluster 7 comprising a support pipe 8 of metal or plastic with an inside diameter of about $1\frac{1}{8}$ inches which is slightly greater than the diameter of the staff 5 and an outside diameter slightly in excess of $1\frac{3}{8}$ inches, and three spacer pipes 9 preferably of plastic, with an outside diameter of about $2\frac{3}{8}$ inches, so that the cluster 7 will fit snugly within the housing 6. As a preferable design for simplicity, the support pipe 8 and the spacer pipes 9 can all have an axial length of about $2\frac{1}{2}$ inches.

In FIG. 5 the cluster 7 is shown positioned within the lower portion of the housing 6, so to leave a space of about $3\frac{1}{2}$ inches above the cluster 7 in the upper portion of the housing 6 to receive the golf ball 3.

The pipes 8 and 9 in the cluster 7 can be secured together as a unit by cement, adhesives, rivets, or other suitable means, and the cluster 7 can be similarly secured to the housing 6 to add rigidity to the assembly forming the cup 4.

It is not necessary to assemble the cluster 7 before being inserted in the housing 6. Instead, the pipes 8 and 9 can be inserted into the housing 6 individually to form the cluster 7 within the housing 6 of the cup 4.

FIG. 6 shows the ball 3 positioned within the housing 6 of the cup 4 when the staff 5 is positioned in the support pipe 8. The ball 3 rests on the spacer pipes 9.

FIG. 7 shows an alternate design for a cup 4 with several spacer pipes 9 of suitable size to fit snugly within the housing 6 and with the support pipe 8 positioned outside the housing 6 and secured thereto by suitable means such as riveting, cement or adhesives.

For this design, a larger number of spacer pipes 9 or spacer pipes 9 of a larger diameter are needed than for the cup shown in FIG. 4 or 6. This design has advantages because the housing 6 can have a smaller inside diameter or have more space to receive the ball 3. However, as a disadvantage, the position of the cup 4 is frequently changed on the green, as previously explained. It is preferable to make a cylindrical opening for the cup in the green and to use a cylindrical plug for insertion in the hole from which the cup has been removed, than to have an irregular shape.

If the flag pole or staff 5 were positioned in the center of the cup 4 the cup would have to have an inside diameter in excess of 7 inches, because the annulus around the staff 5 would need a width in excess of three inches, to accommodate a ball 3 having a diameter of three inches. Within the annulus, the staff 5 would occupy a diameter of about one inch. As to the preferred embodiment of this invention, the opening in the cylindrical housing 6 for the cup 4 is less than twice the size of the golf ball 3 to be received therein.

A cup with an inside diameter in the order of 7 inches is generally considered too large a target for a golf game, especially when the game is to be similar to regulation PGA golf. The similarity is not destroyed when the staff 5 is positioned eccentric to and adjacent to, or as a part of the housing 6, rather than at the axis of the cup 4. When playing the green from the tee or fairway the flag pole or staff 5 is correctly positioned as a target in relation to the cup 4 to help the player to locate and shoot for the cup. This is not possible if the flag pole or staff 5 were to be positioned remote from the cup 4.

Although the invention is directed mostly to a cup with features to accommodate a golf ball much larger than the regulation PGA golf ball, it has been found that commercial pipe of suitable sizes can be used to form the cup for regulation golf with the flag support or staff at the center or axis of the cup.

As to this design, FIG. 8 shows a cup 14 with a housing 16 surrounding spacer pipes 19 and a support pipe 18 at the center or axis of the cup 14. This design of cup would be smaller and have an inside diameter of $4\frac{1}{4}$ inches for regulation golf and would be bigger and have an inside diameter in excess of 7 inches for the game of big ball golf being described.

For added support and rigidity of the pipes in a housing for a cup, a cluster 27 can be designed so that the spacer pipes 29 are cut at a bevel as shown in FIG. 9 and be positioned so that the high edge of each will be at the outside edge of the cluster 27 and adjacent the housing for the cup. By this design and arrangement the bottom of the space for the ball 3 in the cup will be dished and lower at the center, and will approximate more closely the curvature of the ball 3. As an added feature, this design will supply added support adjacent the wall of the housing where added strength is most needed. Such design will not interfere with the space needed to receive the ball 3 in the cup. Also, added support and strength can be provided if the support pipe 28 is longer than the spacer pipes 29 and approaches the length of the housing for the cup. The added length of the support pipe 28 provides a longer contact area between the housing and the support pipe 28 to facilitate securing or fastening one to the other.

Although not recommended because special dies and added costs would be involved, it is to be recognized that the invention, namely to provide a cup with a staff support being positioned eccentric of the axis of the cup, can be carried out by a variation having a support means other than the support pipe 8.

To illustrate this variation, although not recommended for economic reasons, FIG. 10 shows a cup 34 with means for supporting a staff 5 eccentric of its axis comprising a wall structure 36, similar to the housing 6, except that the wall structure 36 is molded with a support opening 38 therein parallel to but eccentric to the axis of the cup 34, such support opening 38 being an integral part of the housing and the equivalent of the support pipe 8 in FIGS. 5, 6 and 7. Suitable spacer pipes 39 similar to the spacer pipes 9 or 19 are positioned within and at the bottom of the wall structure 36 so as to provide space above them to receive the ball 3 in the cup 34.

By using spacer pipes 9, 29 or 39 in the design of any cup shown in the drawings, there is suitable support for the ball 3 when it enters the cup, and there are suitable openings at the bottom of the cup to provide drainage and to receive debris that might collect in the cup.

The cup being described is inexpensive to fabricate and assemble because the pipes used therefor, except for the special housing 36, are readily available in commercial quantities and at reasonable prices. Also if the cluster is too large to fit in the housing, the cluster can be heated and made plastic to change its shape sufficiently to provide a snug fit in the housing for the cup.

I claim as my invention:

1. A golf cup for positioning in a green, with a substantially cylindrical opening therein having an axis to be positioned substantially perpendicular to the green, and having a diameter suitable to receive a golf ball, comprising, (a) A cylindrical housing member formed from pipe, (b) A cluster of individual smaller cylindrical pipe members each having a distinct, generally uniform wall thickness positioned side by side in the lower portion of the housing member, said cluster being of such size as to fit in the cylindrical housing member to form a unitary structure, at least some of the smaller cylindrical pipe members having a length less than the length of the cylindrical housing member, and (c) The cluster comprising an elongated cylindrical support pipe member having an inside diameter suitable to receive the staff and to hold the staff perpendicular to the green, and a plurality of cylindrical spacer pipe members having inside diameters different from the cylindrical support pipe member.

2. A golf cup as specified in claim 1, wherein the cylindrical support pipe member is positioned eccentric to the axis of the cylindrical housing member.

3. A cup for positioning in a green for a golf game employing a ball, having a substantially cylindrical housing with an axis to be positioned substantially perpendicular to the green and with an opening therein to receive the ball, a plurality of individual cylindrical pipe members each having a distinct, generally uniform wall thickness and a length less than the length of the cylindrical housing being positioned adjacent one another in a parallel close relationship within and at the lower portion of the cylindrical housing so as to form a unitary structure, one of said cylindrical pipe members having a suitable opening to receive and support a staff.

* * * * *